US006997742B1

(12) United States Patent
Tung

(10) Patent No.: US 6,997,742 B1
(45) Date of Patent: Feb. 14, 2006

(54) MULTI-LAYER CONNECTOR ASSEMBLY

(76) Inventor: Meng Tung, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/948,170

(22) Filed: Sep. 24, 2004

(51) Int. Cl.
*H01R 13/60* (2006.01)

(52) U.S. Cl. ..... 439/541.5; 439/101

(58) Field of Classification Search ..... 439/541.5, 439/79, 607, 609, 620, 101, 108, 491, 668
See application file for complete search history.

(56) References Cited

U.S. PATENT DOCUMENTS 5,643,008 A * 7/1997 Tan et al. ..... 439/541.5
5,681,183 A * 10/1997 Dzmura ..... 439/502
6,074,218 A * 6/2000 Wu et al. ..... 439/63
6,168,462 B1 * 1/2001 Liao ..... 439/541.5
6,234,824 B1 * 5/2001 Chang ..... 439/346
6,508,665 B1 * 1/2003 Yeh ..... 439/541.5
6,666,716 B1 * 12/2003 Chien-Chung ..... 439/541.5
6,854,983 B1 * 2/2005 Kikuchi et al. ..... 439/79

* cited by examiner

*Primary Examiner*—Hien Vu
(74) *Attorney, Agent, or Firm*—Troxell Law Office, PLLC

(57) ABSTRACT

A multi-layer connector assembly for computer audio signal transmissions includes a plastic housing, two terminal sets and a metal outer housing. The plastic housing is consisted of a plastic body and a terminal stand. The invention is characterized that, the plastic body has an obverse side thereof for installing signal connecting caps having distinct colors serving for identification purposes, and the terminal stand is provided with two symmetrical terminal sets that are bent and arranged in certain manners, thereby reducing a height of the connector assembly by 3 mm.

14 Claims, 8 Drawing Sheets

MULTI-LAYER CONNECTOR ASSEMBLY

BACKGROUND OF THE INVENTION (a) Field of the Invention

The invention relates to a multi-layer connector assembly, and more particularly, to a connector assembly for computer video and audio data transmissions. The multi-layer connector assembly comprises a plastic housing, two terminal sets and a metal outer housing. The plastic housing is consisted of a plastic body and terminal stands, and is bent and arranged in certain manners using the terminal sets, thereby reducing a height of the connector assembly by 3 mm for conforming to requirements of users.

(b) Description of the Prior Art

FIG. 1 shows prior connector assembly for transmitting input or output analog audio data signals. A current computer equipment is commonly provided with 5.1 channels, and a connector for controlling output includes an output opening of front left and right speakers, an output opening of rear left and right speakers, an output opening of a central speaker and an output opening of a bass speaker. As a number of output openings of a signal connector increases, a main body of the connectors becomes a two-layer stacked body or a side-by-side arrangement. When using a side-by-side arrangement, various elements of the connectors are first piled and then covered by a metal housing. The connector assembly is adhered to a corresponding golden finger at a circuit board. However, for being altogether provided at a same circuit board, the aforesaid connector has a drawback of occupying a greater space. In addition, a height of the stacked connector assembly is rather large that difficulties may arise when joining the circuit board with the housing. Thus, not only large amounts and different molds of plastic housings having distinct shapes are needed, but also shapes of terminals are necessarily altered. Time and production costs are both wasted, and hence failing to meet market practicability and economic values. Furthermore, the numerous output openings are long since manufactured into integrals having diverse colors, and are irreplaceable with likable complications incurred during manufacturing processes. Therefore, it is a vital task of the invention as how to provide a connector assembly comprising terminals that are devised in certain designs for reducing an overall height of the connector assembly and can be installed within a plastic body having different amounts of signal openings, and replaceable signal connecting caps having distinct colors serving for identification purposes.

SUMMARY OF THE INVENTION

In view of the aforesaid shortcomings, the invention provides a novel multi-layer connector assembly capable of overcoming the aforesaid drawbacks of the prior invention.

The primary object of the invention is to provide a connector assembly having terminal sets that reduce a height of the connector assembly by 3 mm, thereby adapting to requirements of users.

The secondary object of the invention is to provide a connector assembly having replaceable signal connecting caps with distinct colors serving for easy identification purposes.

To accomplish the aforesaid objects, a multi-layer connector assembly according to the invention comprises a plastic housing, two terminal sets and a metal outer housing. The plastic housing is consisted of a plastic body and a terminal stand. Each terminal set has an audio signal terminal, a ground terminal and a power supply terminal that are each arranged in a downward direction. The ground terminals are situated at a middle section of the terminal sets so as to be shared when put to use. The audio signal terminals are situated at outermost sides of the terminal set and serve for outputting audio signals of left and right sound channels. The power supply terminals are situated at innermost sides of the terminal sets, with a right innermost power supply terminal having a contact end thereof accommodated with a plastic wrap. Moreover, the left innermost power supply terminal is continuously bent to locate a contact end thereof at a right side of a conducting end of the right innermost power supply terminal. At appropriate positions, the audio signal terminals and the power supply terminals are respectively provided with wedge members that can be wedged into a sliding groove at a reverse side of the plastic body. Upper and middle outermost audio terminals are devised in a two-sectional design—the contact ends and the conducting ends are provided as two individual terminals. As a result, a height of the plastic housing is reduced for that heights of upper, middle and lower terminals are all decreased. The terminal stand is divided into various partitions at an interior thereof for placing different terminals; and has terminal openings at a lower portion thereof, and a locating member at an upper rear portion thereof for corresponding with a locating member of the plastic body. The terminal stand also has a locating column at a lower portion thereof. The plastic body is devised with six analog signal connecting openings having a same size at an obverse side thereof. The signal connecting openings are provided in same size and shape for corresponding and accommodating connecting caps. Each of the connecting caps is a hollow cap body, and has a skirt at a periphery thereof and a round opening at a center portion thereof for inserting through a signal joint.

According to the aforesaid structure, because a height of the terminal sets is decreased by 3 mm, a height of the plastic body is consequently reduced by 3 mm. When the terminal sets are corresponding inserted into the terminal stand, an overall height of the connector assembly is reduced. To avoid formation complications, the upper and middle terminals are devised in a two-section design. When inserting an audio output signal plug, a right innermost power supply terminal comes into contact with a left innermost power supply terminal for conduction due to that a right audio signal terminal receives a force imposing to a right side, thereby eliminating noise issues produced when inserting an audio input plug while power is conducted in advance. According to the invention, when being inserted into the sliding groove of the plastic body, the wedge member at the front portion of the terminal set does not come into direct contact with the signal connecting caps. For replacement, signal connecting caps having distinct colors but same dimensions are placed into the signal connecting openings at the front end of the plastic body, so as to accomplish easy identification purposes.

DETAILED DESCRIPTION OF THE PREFERRED EMBODIMENTS

To better understand structures, devices and characteristics of the invention, a preferred embodiment shall be given with the accompanying drawings below.

Figure 1:
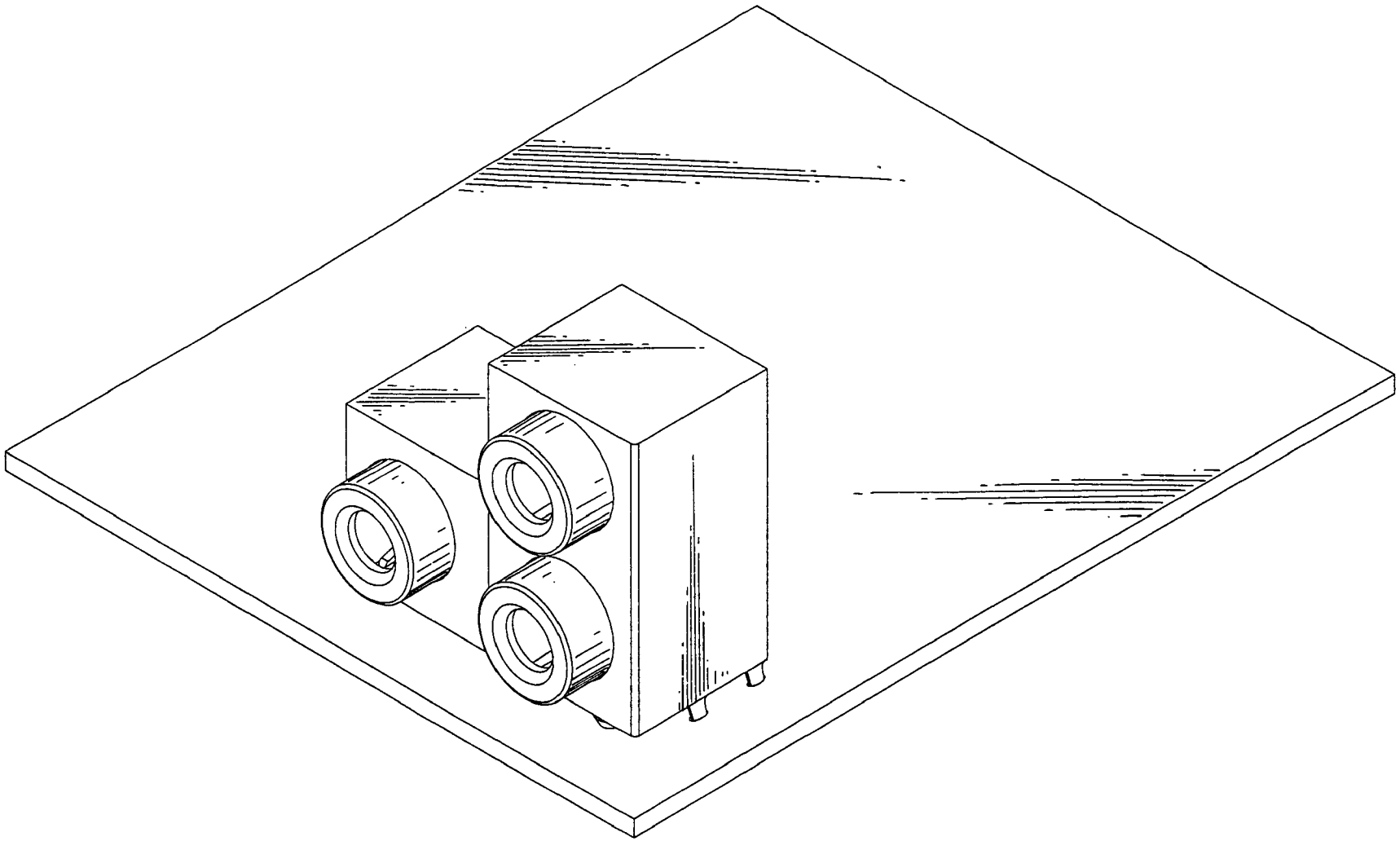
Fig.1 (prior art)
FIG. 1 shows an elevational view of a prior invention.
Figure 2:
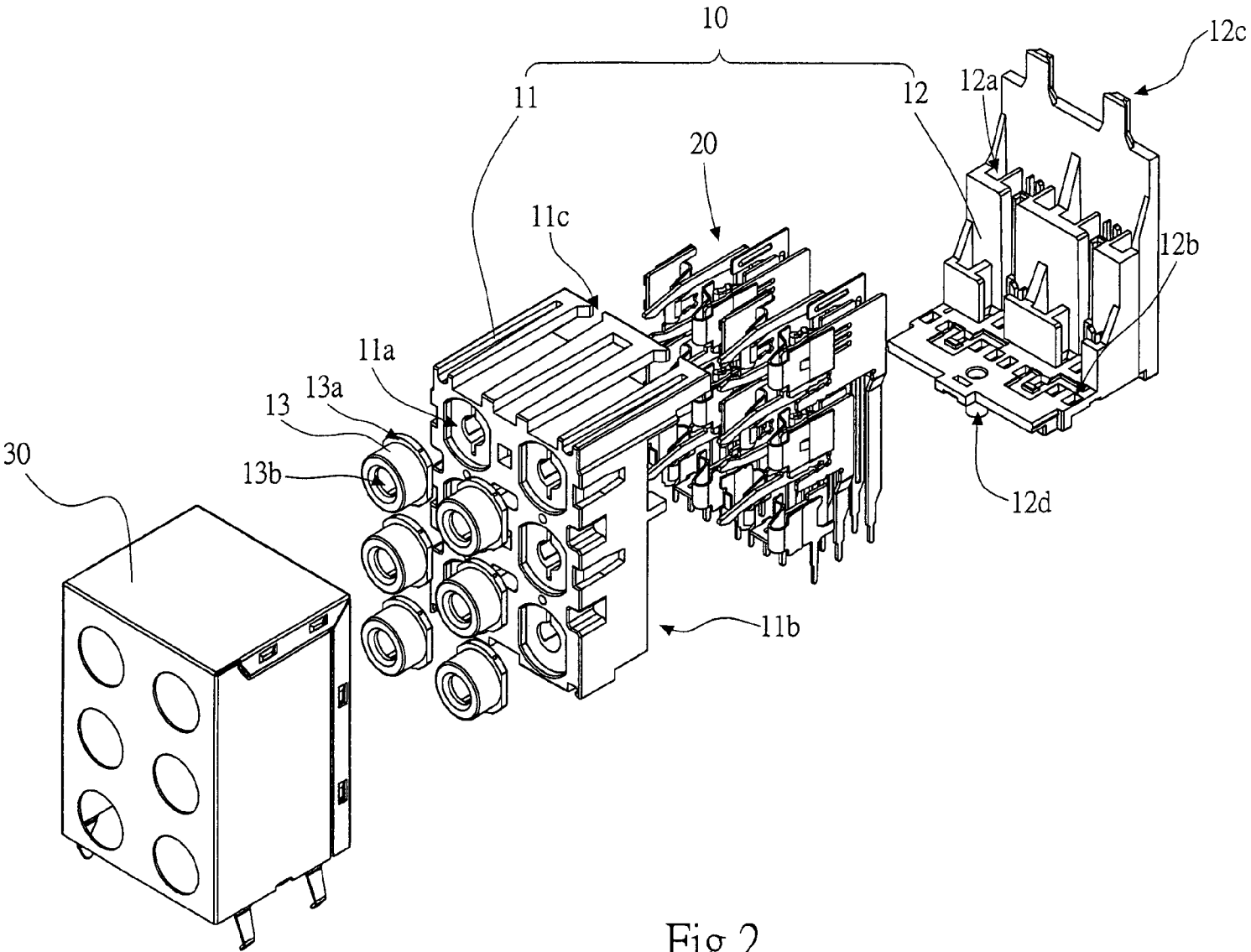
FIG. 2 shows an exploded elevational view according to the invention.
Figure 3:
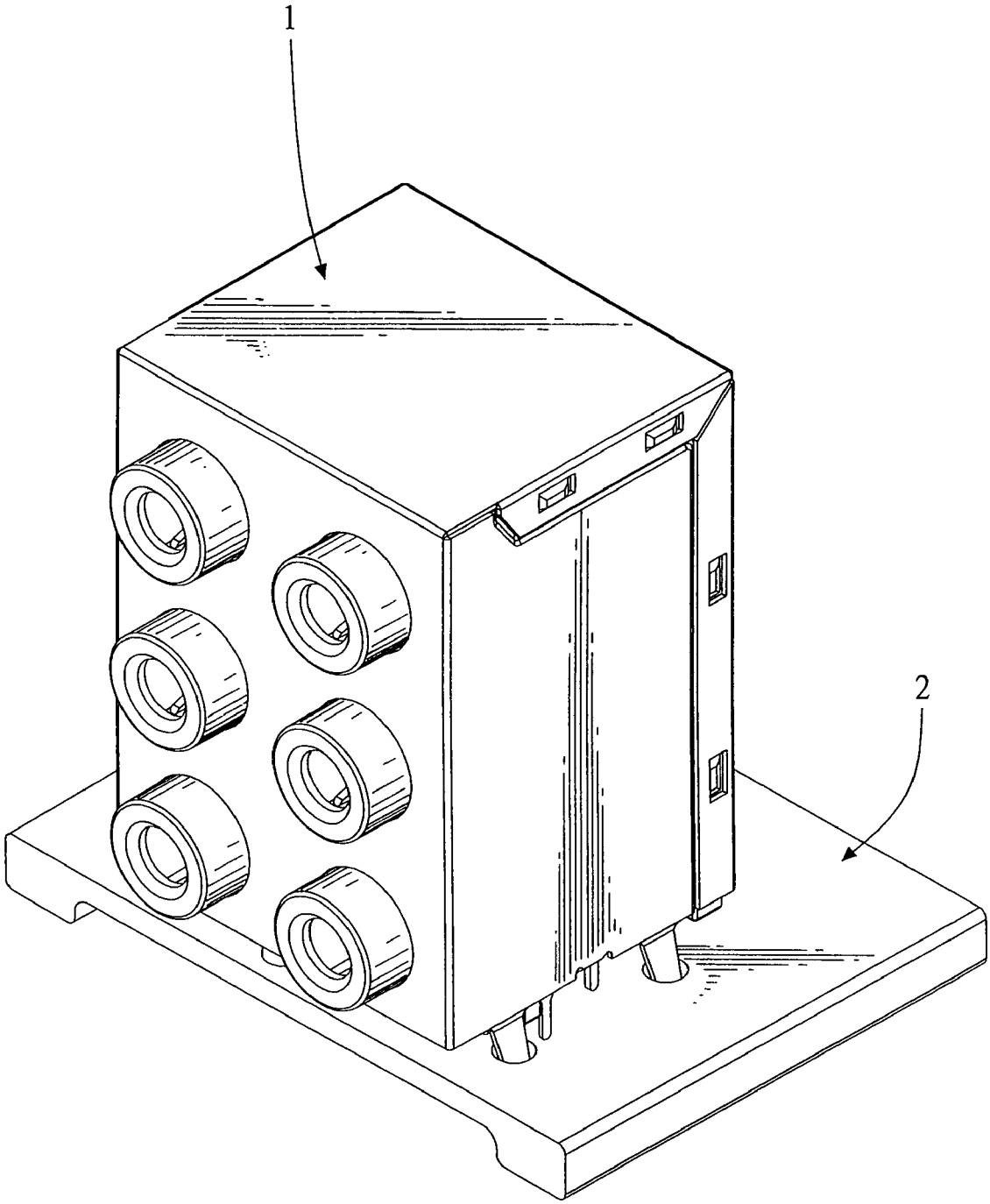
FIG. 3 shows an elevational view according to the invention.
Figure 4B:
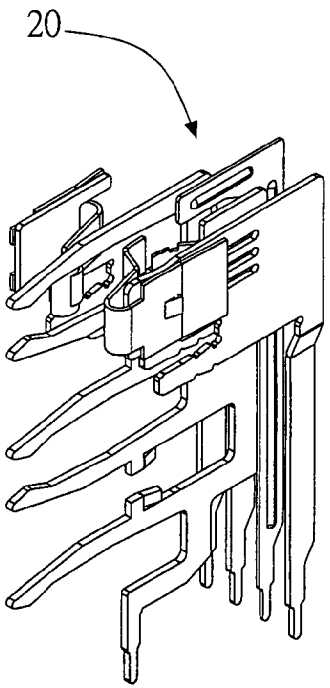
FIG. 4B shows an elevational view of upper-layer terminals according to the invention.
Figure 4A:
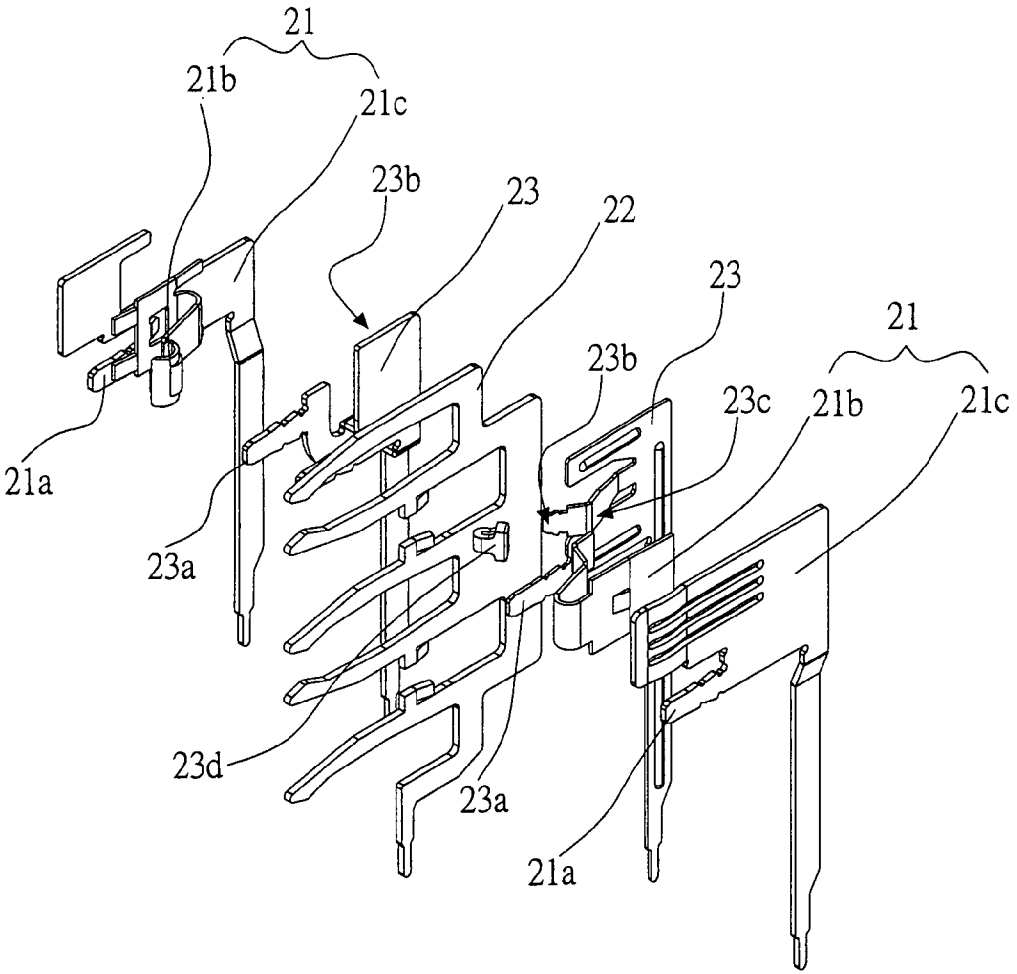
FIG. 4A shows an exploded elevational view of upper-layer terminals according to the invention.
Figure 5B:
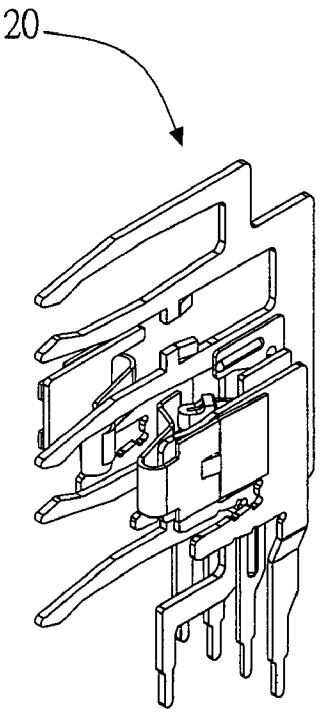
FIG. 5B shows an elevational view of middle-layer terminals according to the invention.
Figure 5A:
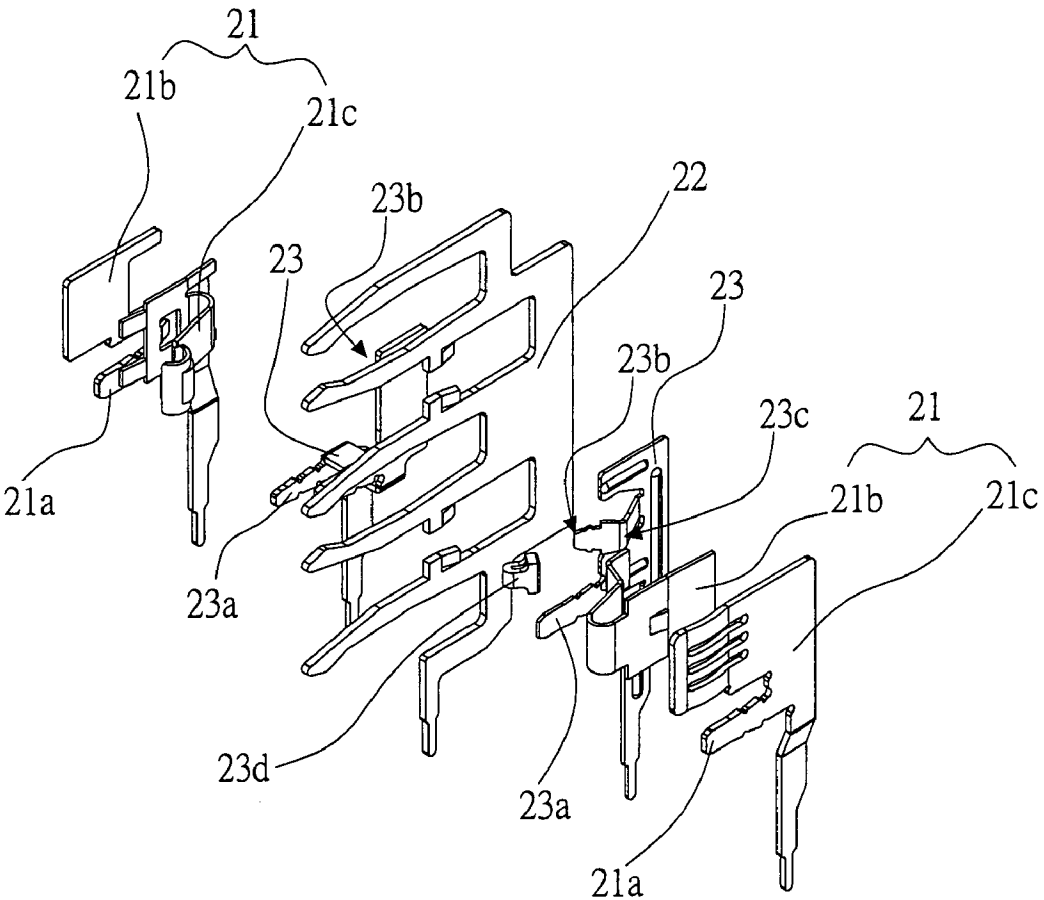
FIG. 5A shows an exploded elevational view of middle-layer terminals according to the invention.
Figure 6B:
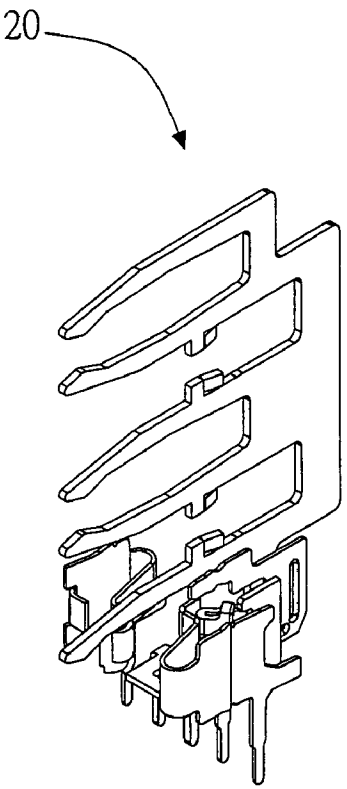
FIG. 6B shows an elevational view of lower-layer terminals according to the invention.
Figure 6A:
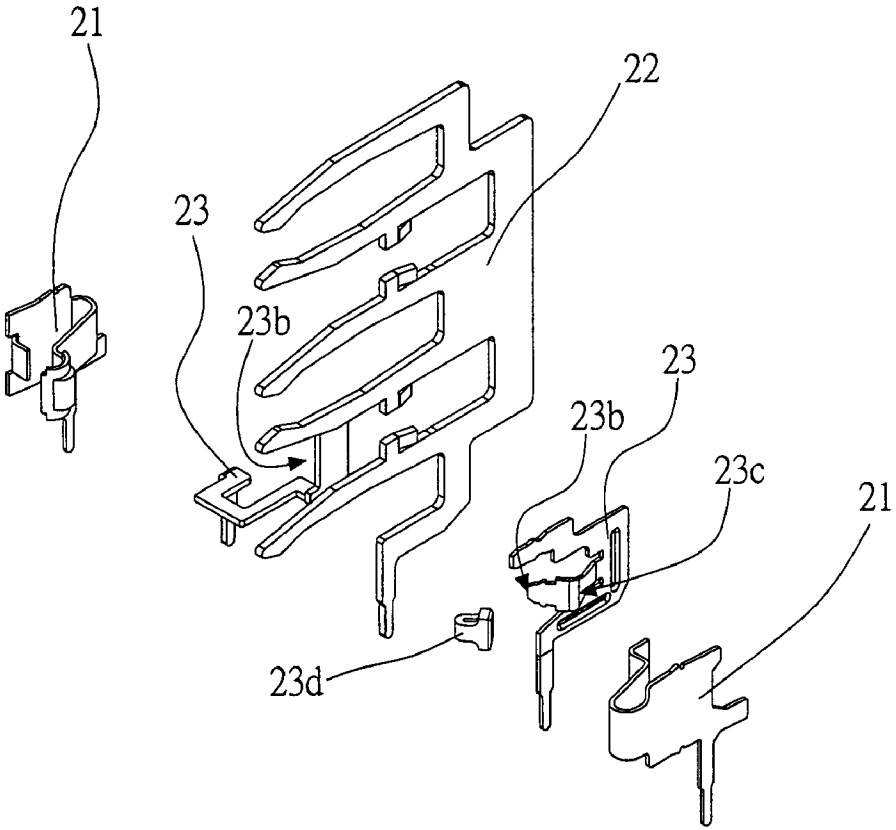
FIG. 6A shows an exploded elevational view of lower-layer terminals according to the invention.

Referring to FIGS. 2 and 3, a multi-layer connector assembly 1 according to the invention comprises a plastic housing 1, two terminal sets 20 and a metal outer housing 30. The plastic housing 10 is consisted of a plastic body 11 and a terminal stand 12. The plastic body 11 is devised with 6 analog signal connecting openings 11*a* having a same size at an obverse side thereof. The signal connecting openings 11*a* are provided in same size and shape for corresponding with connecting caps 13, so as to accommodate the connecting caps 13. Each of the connecting caps 13 is a hollow cap body, and has a skirt 13*a* at a periphery thereof and a round opening 13*b* at a center portion thereof for inserting through a signal joint. The plastic body 11 is devised with a sliding groove 11*b* at a reverse side thereof and a locating member 11*c* at an upper portion thereof for joining with the terminal stand 12. The terminal stand 12 is divided into various partitions at an interior thereof 12*a* for placing different terminals; and has terminal openings 12*b* at a lower portion thereof, and a locating member 12*c* at an upper rear portion thereof for corresponding with the locating member 11*c* of the plastic body 11. The fastening member 11*c* of the plastic housing 11 appears as a clamp in shape; whereas the locating member 12*c* of the terminal stand 12 appears as an inverted V in shape for corresponding with a shape of a front end of the locating member 11*c*, and is inserted into a gap in front via a lower end of the locating member 11*c* of the plastic housing 11. For assembly, a front end of the terminal set 20 is inserted into the sliding groove 11*b* of the plastic body 11, the locating members 11*c* and 12*c* of the plastic body 11 and the terminal stand 12 are fastened with each other, and the skirt 13*a* of the signal connecting cap 13 is exactly butted against a side of the signal connecting opening 11*a*, such that a portion of the signal connecting cap 13 is projected from the plastic body 11. The metal outer housing 30 is covered onto the aforesaid assembled structure, and a positioning column 12*d* at a lower portion of the plastic housing 10 is fixed to a rear side of a circuit board 2.

According to the aforesaid structure, in order to coordinate with the six signal connecting openings 11*a*, the terminal sets 20 are disposed to the terminal stand 12 at left and right sides in a symmetrical manner. With reference to FIGS. 4A, 4B, 5A, 5B, 6A and 6B, each terminal set 20 has an audio signal terminal 21, a ground terminal 22 and a power supply terminal 23 that are each arranged in a downward direction. The ground terminals 22 appears as an F-shape, and are situated at middle sections of the terminal sets 20 so as to be shared when put to use. The audio signal terminals 21 are situated at left and right outermost sides of the terminal sets 20 and serve for outputting audio signals of left and right sound channels. The power supply terminals 23 are situated at left and right innermost sides of the terminal sets 20, with a contact end 23*b* of the right innermost power supper terminal 23 accommodated with a plastic wrap 23*d*. Moreover, the power supply terminal 23 at the left innermost side is continuously bent to locate the contact end 23*b* thereof at a right side of a conducting end 23*c* of the right innermost power supply terminal 23. At appropriate positions, the audio signal terminal 21 and the power supply terminal 23 are respectively provided with wedge members 21*a* and 23*a* that can be wedged into the sliding groove 11*b* at the reverse side of the plastic body 11. Upper and middle outermost audio terminals 21 are devised in a two-sectional design—the contact ends 21*b* and the conducting ends 21*c* are provided as two individual terminals. As a result, a height of the plastic housing 10 is reduced for that heights of upper, middle and lower terminals are all decreased.

Figure 7A:
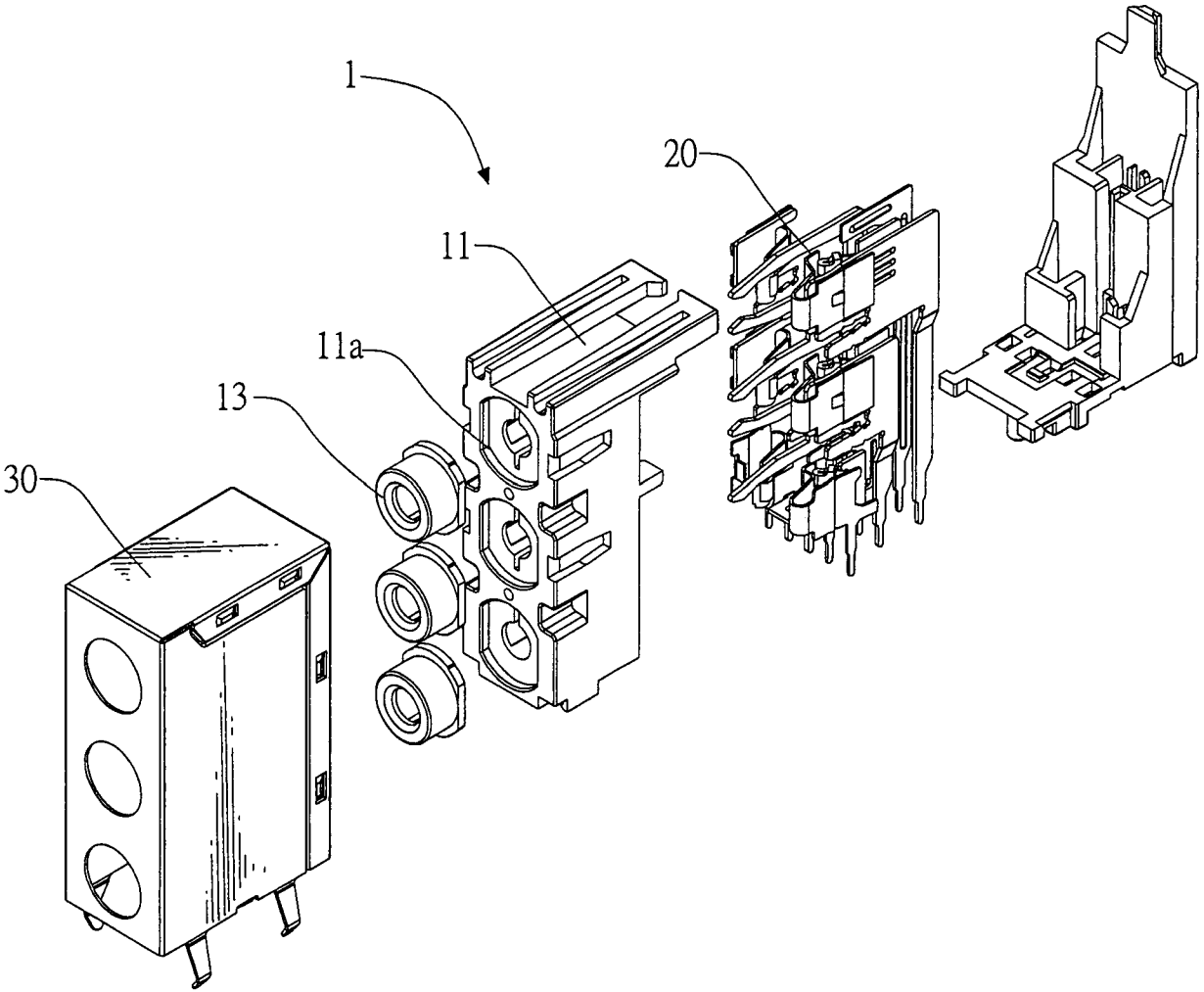
FIG. 7A shows an exploded elevational view of another embodiment according to the invention.
Figure 7B:
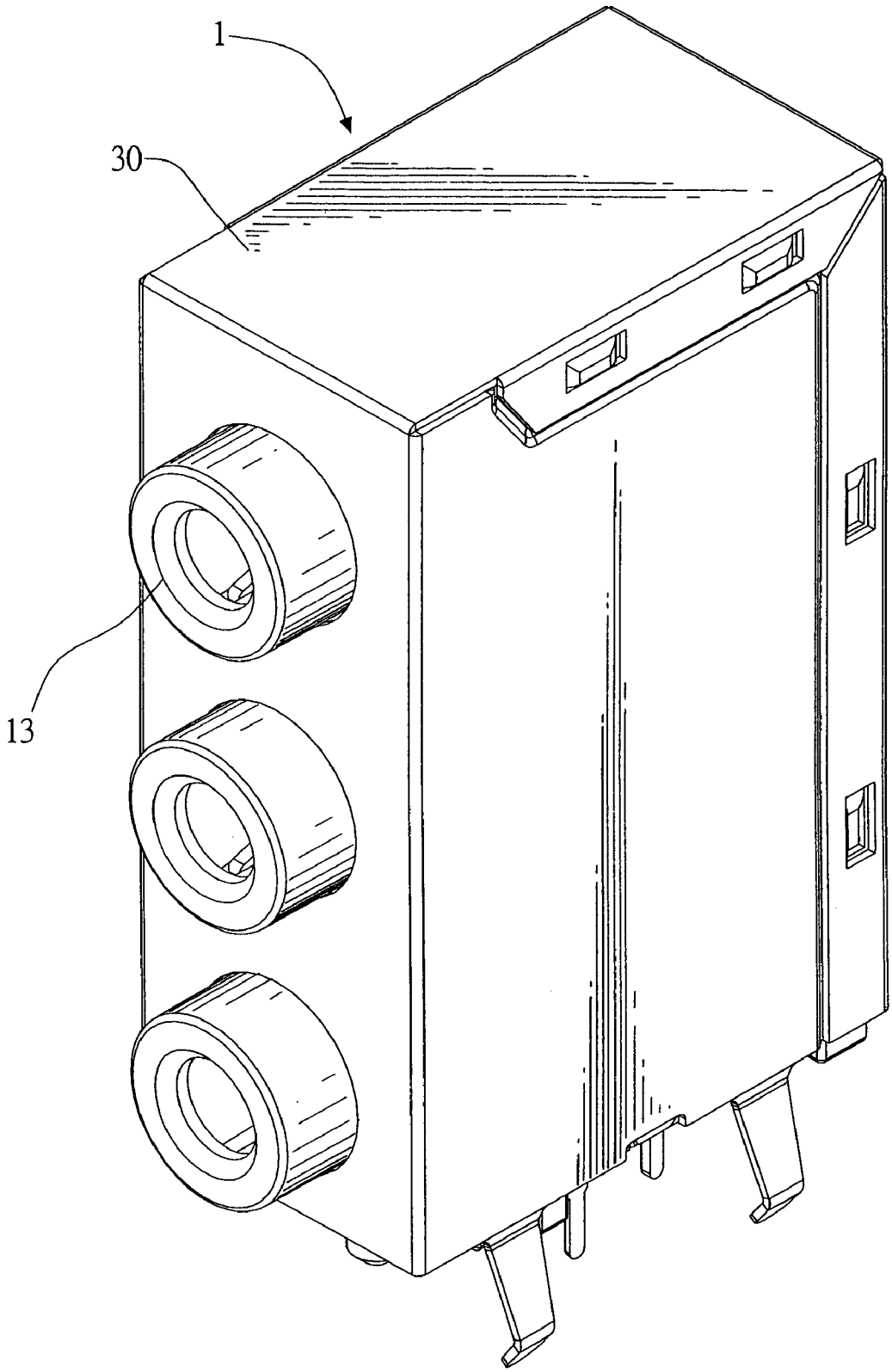
FIG. 7B shows an exploded elevational view of another embodiment according to the invention.

Referring to FIGS. 7A and 7B showing another embodiment according to the invention, one set of the symmetrical terminal is directly disposed at a plastic body 11, which has a width half of that of the aforesaid structure and three signal connecting openings 11*a* for installing three connecting caps 13. A metal outer housing having three openings is used for coverage to complete an assembled connector assembly 1. Not only an overall height of the connector assembly 1 is reduced, but also issues as having to re-design the terminals 20 are eliminated, thereby lowering production costs.

Conclusive from the above, the multi-layer connector assembly according to the invention, using certain bending and arrangement for decreasing heights of terminal sets and a plastic housing thereof, has a reduced overall height. In addition, signal connecting caps according to the invention are readily replaced while also serving for identification purposes. Above all, the terminal sets according to the invention are capable of eliminating noises produced when inserting an audio signal plug, thereby further enhancing practicability of the invention.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A multi-layer connector assembly for computer audio data transmissions comprising:

a) a plastic housing having:

i) a plastic body having at least one set of three analog signal connecting openings, each of the three analog signal connecting openings having a signal connecting cap having a predetermined color; and ii) a terminal stand connected to the plastic body;

b) at least one terminal set positioned in an interior of the terminal stand and having a ground terminal, each of the at least one terminal set having three terminal layers including upper-layer terminals, middle-layer terminals, and lower layer terminals, each of the three terminal layers having two audio signal terminals and two power supply terminals; and c) a metal outer housing located around the plastic housing;

wherein the ground terminal is located at a middle section of each of the three terminal layers;

wherein the plastic body having a sliding groove, each of the two audio signal terminals and the two power supply terminals having a wedge member located in the sliding groove.

2. The multi-layer connector assembly according to claim 1, wherein a first audio signal terminal of the two audio signal terminals is located on a left outermost side of each of the three terminal layers and outputs audio signals of a left sound channel, and a second audio signal terminal of the two audio signal terminals is located on a right outermost side of each of the three terminal layers and outputs audio signals of a right sound channel.

3. The multi-layer connector assembly according to claim 1, wherein a first power supply terminal of the two power supply terminals is located on a left innermost side of each of the three terminal layers, and a second power supply terminal of the two power supply terminals is located on a right innermost side of each of the three terminal layers.

4. The multi-layer connector assembly according to claim 3, wherein the second power supply terminal has a contact end having a plastic wrap.

5. The multi-layer connector assembly according to claim 3, wherein the first power supply terminal includes a contact end, the second power supply terminal includes a conducting end, the first power supply terminal is bent and the contact end is located on a right side of a conducting end of the second power supply terminal.

6. The multi-layer connector assembly according to claim 1, wherein each of the two audio signal terminals of the upper-layer terminals and the middle-layer terminals having a first audio signal terminal and a second audio signal terminal, each of the first audio signal terminal and the second audio signal terminal having a contact end and a conducting end being two individual terminals.

7. The multi-layer connector assembly according to claim 1, wherein the at least one set of three analog signal connecting openings of the plastic is two sets of three analog signal connecting openings, and the at least one terminal set is two terminal sets.

8. The multi-layer connector assembly according to claim 7, wherein the ground terminal is located at a middle section of each of the three terminal layers.

9. The multi-layer connector assembly according to claim 7, wherein a first audio signal terminal of the two audio signal terminals is located on a left outermost side of each of the three terminal layers and outputs audio signals of a left sound channel, and a second audio signal terminal of the two audio signal terminals is located on a right outermost side of each of the three terminal layers and outputs audio signals of a right sound channel.

10. The multi-layer connector assembly according to claim 7, wherein a first power supply terminal of the two power supply terminals is located on a left innermost side of each of the three terminal layers, and a second power supply terminal of the two power supply terminals is located on a right innermost side of each of the three terminal layers.

11. The multi-layer connector assembly according to claim 10, wherein the second power supply terminal has a contact end having a plastic wrap.

12. The multi-layer connector assembly according to claim 10, wherein the first power supply terminal includes a contact end, the second power supply terminal includes a conducting end, the first power supply terminal is bent and the contact end is located on a right side of a conducting end of the second power supply terminal.

13. The multi-layer connector assembly according to claim 7, wherein the plastic body having a sliding groove, each of the two audio signal terminals and the two power supply terminals having a wedge member located in the sliding groove.

14. The multi-layer connector assembly according to claim 7, wherein each of the two audio signal terminals of the upper-layer terminals and the middle-layer terminals having a first audio signal terminal and a second audio signal terminal, each of the first audio signal terminal and the second audio signal terminal having a contact end and a conducting end being two individual terminals.

* * * * *